US007252601B2

(12) United States Patent
Sato et al.

(10) Patent No.: US 7,252,601 B2
(45) Date of Patent: Aug. 7, 2007

(54) GOLF BALL

(75) Inventors: Katsunori Sato, Chichibu (JP); Atsuki Kasashima, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 11/181,872

(22) Filed: Jul. 15, 2005

(65) Prior Publication Data

US 2006/0068940 A1 Mar. 30, 2006

Related U.S. Application Data

(63) Continuation-in-part of application No. 10/950,810, filed on Sep. 28, 2004, now abandoned.

(51) Int. Cl.
*A63B 37/12* (2006.01)

(52) U.S. Cl. ..... 473/383

(58) Field of Classification Search ..... 473/378–385
See application file for complete search history.

(56) References Cited

U.S. PATENT DOCUMENTS 5,143,377 A * 9/1992 Oka et al. ..... 473/383
6,290,615 B1 * 9/2001 Ogg ..... 473/378
6,291,615 B1 9/2001 Ogg
6,336,873 B1 * 1/2002 Yamagishi et al. ..... 473/378
6,461,253 B2 10/2002 Ogg
6,695,720 B2 2/2004 Sullivan
6,802,787 B2 * 10/2004 Ogg ..... 473/378
6,884,183 B2 4/2005 Sullivan
6,899,643 B2 * 5/2005 Sajima et al. ..... 473/383
6,905,426 B2 6/2005 Morgan et al.

* cited by examiner

*Primary Examiner*—Raeann Trimiew
(74) *Attorney, Agent, or Firm*—Sughrue Mion, PLLC

(57) ABSTRACT

Disclosed herein is a golf ball having on its surface a number of dimples and a number of edges separating dimples from each other, wherein the edges are formed from a plurality of edge elements joined together such that some of the joining parts of the edge elements assume a smoothly curved shape as viewed from above. The golf ball has improved aerodynamic performance due to dimples and achieves a long flying distance.

17 Claims, 4 Drawing Sheets

GOLF BALL

CROSS-REFERENCE TO RELATED APPLICATION

This application is a continuation-in-part of application Ser. No. 10/950,810 filed on Sep. 28, 2004 now abandoned, the entire contents of which are hereby incorporated by reference.

BACKGROUND OF THE INVENTION

The present invention relates to a golf ball which excels in flight performance.

For a golf ball to fly over a long distance, it should have a high rebound resilience and a low aerodynamic resistance attributable to dimples arranged on its surface. For the purpose of reducing aerodynamic resistance, there have been proposed several methods for arranging dimples on the ball surface as densely and uniformly as possible.

FIG. 7 illustrates a golf ball (G) with dimples (s) arranged in an ordinary manner. Each dimple is a circular dent as viewed from above. If such circular dimples (s) are to be densely arranged, it is necessary to narrow down the flat part or land (t) separating adjoining dimples from each other. Even though the flat part (t) is infinitely narrow, there still exists a triangular or rectangular flat part of certain size in the area surrounded by three or four dimples. On the other hand, it is essential to arrange dimples as uniformly as possible on the ball's spherical surface. This necessitates making a compromise between the density and the uniformity of dimple arrangement.

One conventional way to achieve the object of arranging dimples densely and uniformly was to arrange two to five kinds of dimples differing in diameter assuming that the ball's spherical surface is a polyhedron (e.g., regular octahedron or icosahedron).

However, as far as dimples are circular, the total area of dimples practically accounts for only 75% or so in the surface area of the sphere, with the remainder being the area of flat parts or land.

On the other hand, U.S. Pat. No. 6,290,615 discloses a new golf ball which has, in place of conventional dimples, a number of small hexagonal segments divided by thin ridges extending in a lattice pattern on the smooth spherical surface.

However, such small hexagonal segments (which are not dimples) constitute the spherical surface whose center coincides with the center of the golf ball. Therefore, they do not reduce aerodynamic resistance so effectively.

SUMMARY OF THE INVENTION

The present invention was completed in view of the foregoing. It is an object of the present invention to provide a golf ball which has improved aerodynamic performance due to dimples and achieves a long flying distance.

After their extensive researches to achieve the above-mentioned object, the present inventors found that a golf ball having a number of dimples separated by edges on its surface exhibits improved aerodynamic performance due to dimples if the edges are formed from two or more edge elements joined together such that all or part of the joined parts as viewed from above are smoothly curved. The present invention is based on this finding.

In general, the flight performance of a golf ball is affected by the total area of dimples that accounts for in the surface area of the golf ball. The greater the total area of dimples, the better the aerodynamic performance. The present invention is characterized in that the shape of the flat part or land is optimized so as to maximize the total area of the dimples. The golf ball designed in this manner has much better aerodynamic performance than conventional ones. An increase in the total area of dimples on the ball surface means a decrease in the area of flat parts. The present inventors found that the shape of flat parts separating dimples from each other greatly affects the flying distance of the golf ball. The present invention provides the golf ball defined in the following.

[1] A golf ball having on its surface a number of dimples and a number of edges separating dimples from each other, wherein the edges are formed from a plurality of edge elements joined together such that some of the joining parts of the edge elements assume a smoothly curved shape as viewed from above.

[2] The golf ball of [1], wherein the dimples include non-circular dimples and the joining parts of the edge elements dividing the non-circular dimples assume a smoothly curved shape as viewed from above.

[3] The golf ball of [1], wherein the joining parts, which assume a smoothly curved shape as viewed from above, are arcs with a radius of curvature (R) of 0.5 to 10 mm.

[4] The golf ball of [1], wherein the edge element has a cross section assuming an arc.

[5] The golf ball of [1], wherein the dimples are formed by combination of circular dimples and non-circular dimples.

[6] The golf ball of [1], wherein the wall surface of dimples which continues from the curved joining part of the edge elements is formed in a curved shape like the curved joining part.

[7] The golf ball of [5], wherein the proportion of the non-circular dimples to the total of the dimples is 50 to 75%.

[8] The golf ball of [1], wherein it is hypothesized that the golf ball is a sphere having no dimples on its surface, the ratio of the space of dimples to the volume of the hypothetic sphere is 1.1 to 1.7%

DETAILED DESCRIPTION OF THE PREFERRED EMBODIMENT

The invention will be described below in more detail with reference to the accompanying drawing.

Figure 1:
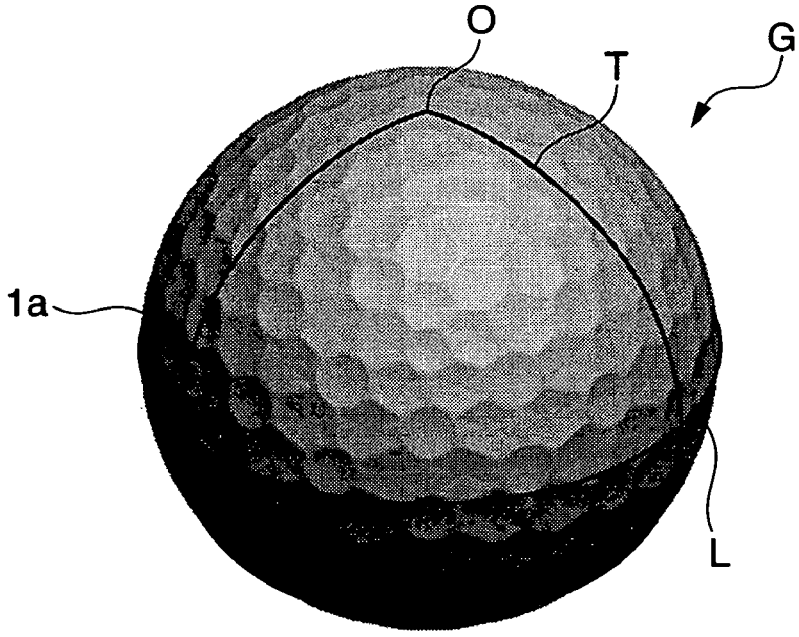
FIG. 1 is a photograph showing the golf ball of Example 1 of the present invention.
Figure 2:
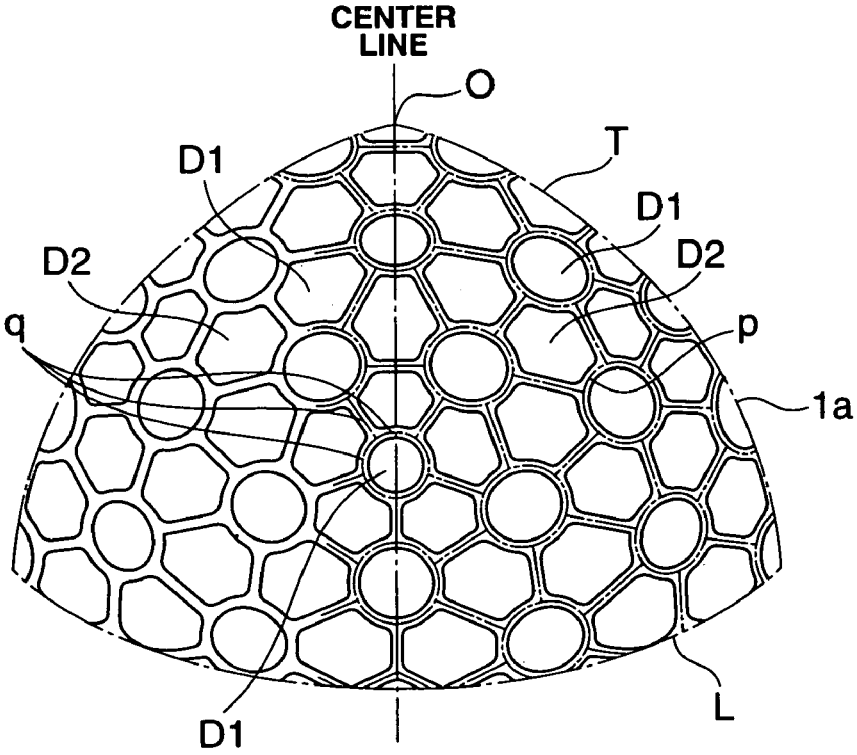
FIG. 2 is a partly enlarged view of the surface of the golf ball shown in FIG. 1.
Figure 3:
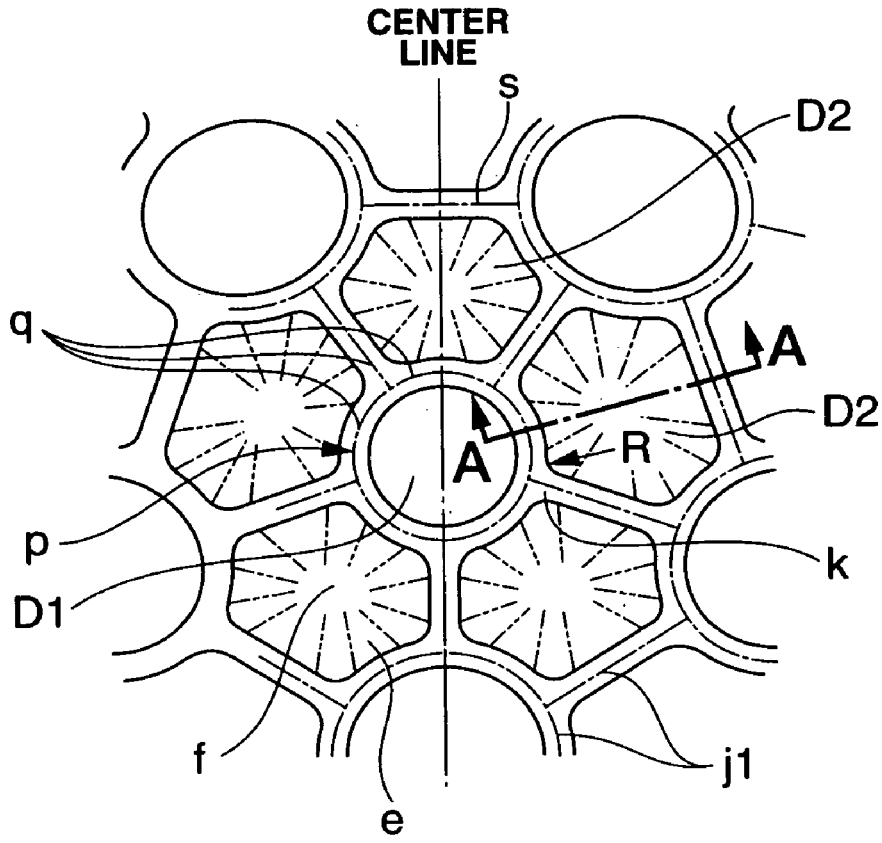
FIG. 3 is a further enlarged view of a part of FIG. 2.
Figure 4:
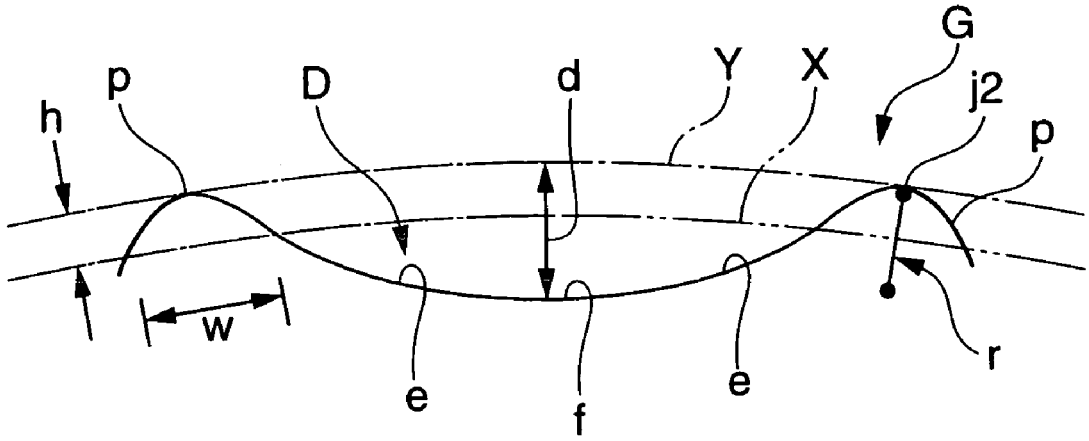
FIG. 4 is a sectional view taken along the line A-A in FIG. 3.

FIG. 1 is a photograph (plan view) showing the golf ball pertaining to Example 1 of the present invention. FIG. 2 is a partly enlarged view of FIG. 1. FIG. 3 is a further enlarged view of a part of FIG. 2. FIG. 4 is a sectional view taken along the line A-A in FIG. 3.

The golf ball according to one embodiment of the present invention has a number of dimples (D) arranged on its surface as shown in FIGS. 1 to 3, such that the dimples are separated from each other by edges (p). The edge (p) has the elongated apexes (j2) of the edge, which is indicated by chain lines in FIGS. 2 and 3. (The apexes are at the farthest position in radial direction from the center of the ball.) In this embodiment, the edge (p) is formed from five or six edge elements (q) for one circular dimple (D1). Similarly, the edge (p) is formed from six edge elements (q) for one non-circular dimple (D2). The edge element (q) between two adjoining dimples is held by them in common. The part where two or more edge elements (q) join together (or the part where three edge elements (q) join together in this embodiment) forms something like a junction of three roads. The "junction" has a smoothly curved part (as viewed from above) which has a radius of curvature (R) indicated by R in FIG. 3.

According to this embodiment, the dimple has a cross section as shown in FIG. 4 (which is a sectional view). The edge (p) is formed within the range (h) between the one-dot chain line (Y) and the two-dot chain line (X). The range (h) extends in the radial direction toward the center of the ball. The one-dot chain line (Y) connects the apexes (j2) of the edges (p) of the dimple and forms the outermost surface of the ball (G). The two-dot chain line (X) is a reference line concentric to the one-dot line (Y). The edge (p) should preferably be formed such that its top has an outwardly curved cross section, with the radius (r) being from 0.2 to 5.0 mm. The concave inwardly extending from the reference line (X) constitutes the major part of the dimple. The position of the reference line (X) may be determined by a line connecting each inflection point between the convex of the edge (p) and the concave of the dimple. The bottom of the dimple should be 0.1 to 0.5 mm away from the line (Y) representing the outermost surface of the ball, as indicated by the depth (d). The height of the edge should be 0.01 to 0.2 mm, as indicated by the distance (h).

In FIGS. 2 and 3, the edge (p) demarcating dimples is indicated by straight or curved parallel lines. These parallel lines follow the positions on the reference line (X). They keep the width (w), except at the junction (k) of the edge elements (q). The edge keeping the width (w) has substantially the same cross section.

According to this embodiment, the dimples are arranged by dividing the ball surface (s) into six sections in the following manner. The ball is halved along its equator, and then each semisphere is divided into three longitudinally at intervals of 120°. Incidentally, FIG. 2 is a partly enlarged view showing one of the six spherical triangles (T), which is surrounded by the equator (L) and two longitudes 120° apart.

According to the present invention, the arrangement of dimples mentioned above is achieved by using two kinds of circular dimples differing in diameter. The large circular dimple (D1) is surrounded by six non-circular dimples (D2) radiating outward like petals. Non-circular dimples (D2) are held in common between two circular dimples (D1) which are closest to each other.

On the other hand, a comparatively small circular dimple (D1) is arranged on the center line of the unit spherical triangle (T), which passes through the vertex of the spherical triangle (T) coinciding with the pole (O) and the center of the base. This small circular dimple (D1) is surrounded by five non-circular dimples (D2) radiating outward like petals.

As shown in FIG. 3, adjoining dimples are demarcated by edge elements (q). The edge element (q) between the circular dimple (D1) and the non-circular dimple (D2) is curved and the edge element (q) between two non-circular dimples (D2) is straight. Three edge elements form a three-forked junction (k). In other words, each three-forked junction of edge elements (q) demarcates one circular dimple (D1) and two non-circular dimples (D2). That part of the junction facing the non-circular dimple (D2) is smoothly curved with a radius of R, which is 0.5 to 10 mm, preferably 0.5 to 5.0 mm. If the radius (R) is smaller than 0.5 mm, the resulting golf ball experiences an increased air resistance. If the radius (R) is larger than 10 mm, the resulting golf ball is poor in appearance, with dimples having an unintended shape. Incidentally, in this embodiment, the non-circular dimple (D2) assumes a polygon having its corners rounded, with the radius of curvature being R.

The non-circular dimple (D2) is formed such that its wall surface (e) assumes a concave shape extending from the curved junction (k) of the edge elements (q) to the bottom (f). The wall surface (e) is defined by the two-dot chain line. The part from the curved corner to the apex (j2) of the junction (k) (where three one-dot chain lines cross each other) assumes a smoothly curved concave shape. On the other hand, the wall surface (e) extending from the arcuate edge element (q) of the non-circular dimple (D2) to the bottom (f) assumes a convex shape. Similarly, the wall surface (e) extending from the straight edge element (q) to the bottom (f) assumes a flat shape. The wall surfaces (e) assuming a concave shape, a convex shape, and a flat shape smoothly join together as they approach the bottom (f).

The arrangement of dimples mentioned above is applicable to the ball surface divided into six sectors. However it is also possible to arrange dimples on the ball surface divided into spherical octahedron, dodecahedron, or icosahedron.

The total number of dimples (D) to be formed on the ball surface (s) should be no less than 100, preferably no less than 250, and no more than 500, preferably no more than 450.

In the Example 1, the total number of dimples is 338. Among the dimples, the number of the non-circular dimples is 224 (approximately 66.3%) and others are circular dimples whose number is 114. When the dimples are formed by combination of circular dimples and non-circular dimples described above, the proportion of the non-circular dimples to the total of the dimples is 50% to 75%, preferably 55% to 70%.

The space of dimples that accounts for the total volume of the ball is explained below with reference to FIG. 4. It is hypothesized that the golf ball is a sphere having no dimples on its surface (s), and the volume of the hypothetic sphere is calculated. Then, the total space of dimples surrounded by the outer surface (Y) of the ball and the concave part of dimples is calculated. The ratio of the space of dimples to the volume of sphere should be no less than 1.1%, preferably no less than 1.2%, more preferably no less than 1.25%, and no more than 1.7%, preferably no more than 1.65%, more preferably no more than 1.6%. The result of specifying the space of dimples as mentioned above is that the golf ball does not fly high or drop without fly when hit by a driver for a long flying distance.

Figure 8:
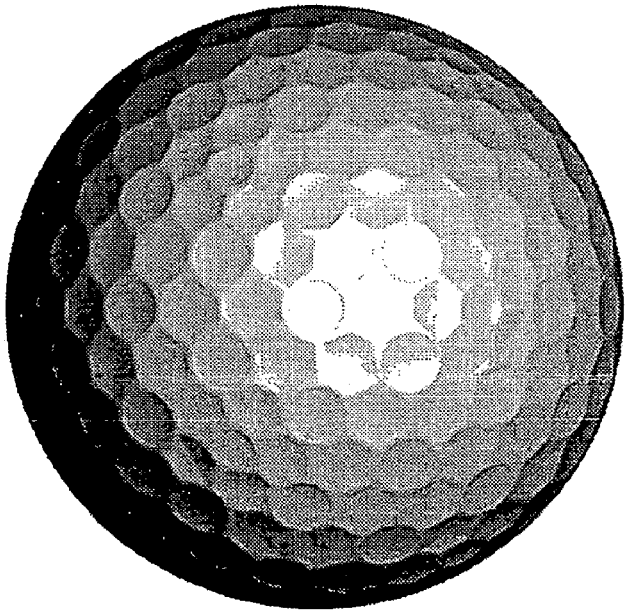
FIG. 8 is a photograph showing the golf ball of Example 2 of the present invention.

FIG. 8 is a photograph (plan view) showing the golf ball pertaining to Example 2 of the present invention. The Example is similar to Example 1 in view of the construction and the shape of dimples and the dimple arrangement to the ball surface. In the Example 2, the total number of dimples is 326 and the number of the non-circular dimples is 216 (approximately 66.3%) and others are circular dimples whose number is 110.

The golf ball according to the present invention may be formed by using a split mold which is prepared by three-dimensional direct cutting by means of 3DCAD•CAM.

The spherical split mold should have a parting line along the equator (L). As shown in FIGS. 1 and 2, this parting line should preferably coincide with the line passing through the apexes (j2) of the edges (p) which repeatedly cross the equator (L) from one semisphere to the other.

Figure 5:
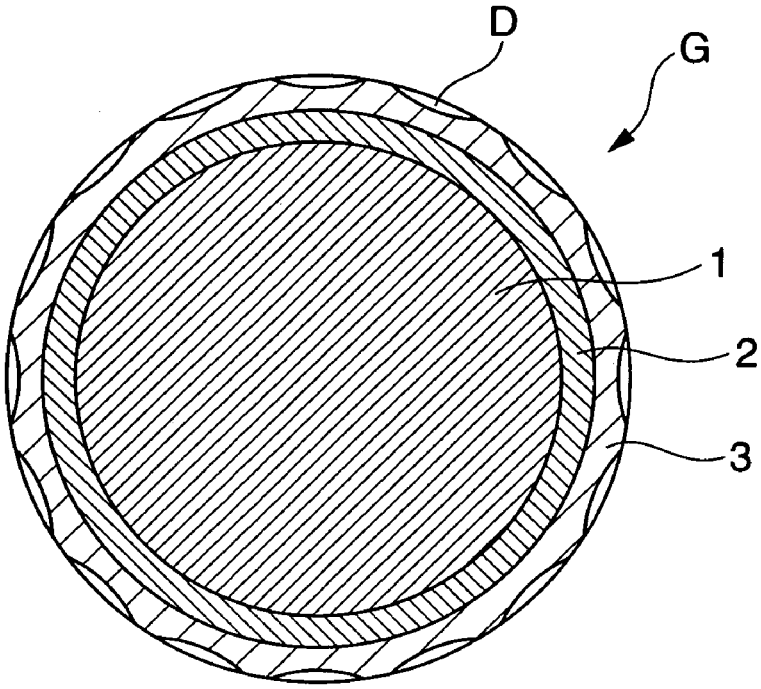
FIG. 5 is a sectional view showing the internal structure of the golf ball used in Examples of the present invention.

The golf ball according to the present invention is not specifically restricted in structure. It may be a multi-piece solid golf ball (with one or more layers) or a thread-wound golf ball. A typical example of the golf ball is shown in FIG. 5. It is composed of an elastic solid core (1) and a cover (3), with one or more intermediate layers (2) interposed between them.

The golf ball (G) shown in FIG. 5 has an elastic core (1) which is made mainly of polybutadiene. This core should be resilient enough to undergo a certain amount of deflection when compressed under an initial load of 98 N (10 kgf) and a subsequent load of 1274 N (130 kgf). The amount of deflection is not specifically restricted; however, it should be no less than 2.0 mm, preferably no less than 2.5 mm, and no more than 4.5 mm, preferably no more than 4.0.

The cover (3) may be formed from any known thermoplastic or thermosetting polyurethane resin. The intermediate layer (2) may be formed from an ionomer resin.

The cover should have an adequate hardness (in terms of Shore D hardness) for proper spin and rebound resilience. The hardness is not specifically restricted; however, it should be no less than 45, preferably no less than 50, and no more than 75, preferably no more than 63.

The intermediate layer should have an adequate hardness (in terms of Shore D hardness) for proper spin and rebound resilience. The hardness is not specifically restricted, however, it should be no less than 45, preferably no less than 50, and no more than 70, preferably no more than 60.

The cover and intermediate layer are not specifically restricted in thickness. However, their thickness should preferably be 1.0 to 1.5 mm and 1.0 to 2.0 mm, respectively. The weight and diameter of the golf ball may be adequately established according to the golf rules.

EXAMPLES

The invention will be described with reference to the following Examples and Comparative Examples, which are not intended to restrict the scope of the invention.

Example 1 & 2 and Comparative Examples 1 & 2

Figure 6:
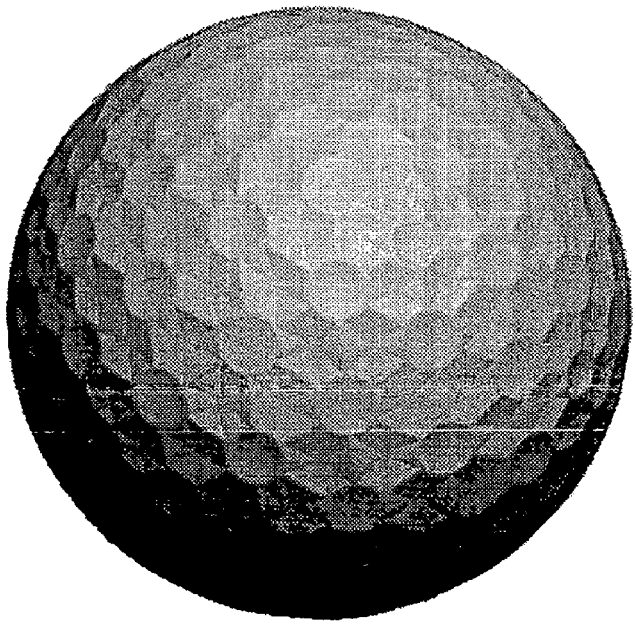
FIG. 6 is a photograph showing the golf ball of Comparative Example 1.
Figure 7:
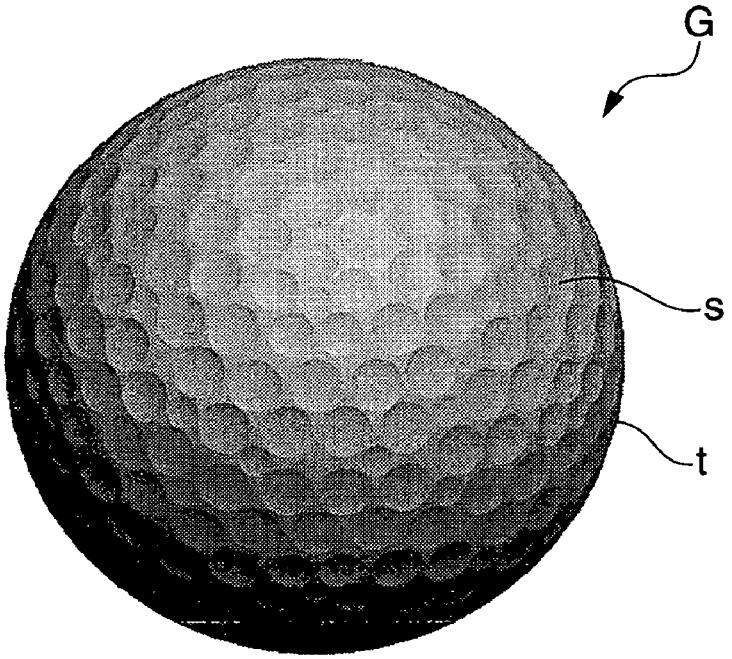
FIG. 7 is a photograph showing the golf ball of Comparative Example 2.

Golf ball samples were prepared, each having dimples arranged as shown in FIG. 1 (Example 1), FIG. 8 (Example 2), FIG. 6 (Comparative Example 1), and FIG. 7 (Comparative Example 2). They were tested for flight performance. Dimples are arranged on the spherical surface divided into six sectors (in Examples 1-2 and Comparative Example 1) or icosahedron (in Comparative Example 2).

The golf ball samples in these examples are of three-piece structure consisting of a core (1), a cover (3), and an intermediate layer (2), as shown in FIG. 5. The details of each constituent are given below.

Core

The core was formed from a rubber composition composed of the following components.

Polybutadiene (100 pbw), "BR01" from JSR.

Zinc acrylate (25 pbw).

Dicumyl peroxide (0.8 pbw), "Percumyl D" from NOF Corp.

1,1-bis(t-butylperoxy)-3,3,5-trimethylcyclohexane (0.8 pbw), "Perhexa 3M-40" from NOF Corp.

Antioxidant (0.2 pbw), "Nocrac NS-6" from Ouchi Shinko Chemical Industry Co.

Zinc oxide (25 pbw).

Zinc salt of pentachlorothiophenol (0.5 pbw).

Zinc stearate (5 pbw).

The rubber composition was vulcanized at 160° C. for 20 minutes. The resulting core was tested for compressive deflection under an initial load of 10 kgf and a subsequent load of 130 kg. The value of deflection was 3.5 mm.

Intermediate Layer and Cover

Using a mold in which the solid core prepared as mentioned above was placed, injection molding was carried out to form the intermediate layer on the core. The material for the intermediate layer was a blend of "Himilan 1605" (ionomer resin from DuPont-Mitsui Polychemicals Co., Ltd.), "Dynalon E6100P" (polybutadiene block copolymer from JSR), and behenic acid (from NOF Corp.). The core enclosed by the intermediate layer was placed in another mold, and injection molding was carried out in this mold to form the cover. The material for the cover was a blend of "Pandex T8295" (thermoplastic polyurethane elastomer from DIC Bayer Polymer Ltd.) and "Crossnate EM-30" (isocyanate master batch from Dainichiseika Color & Chemicals Mfg. Co., Ltd.). The Shore D hardness of the intermediate layer and cover was 56 and 50, respectively.

Ball Testing

The samples of golf balls were examined for flying distance by using a driver (W#1) fixed to a hitting machine which was adjusted so that the initial velocity is 45 m/s and the launch angle is 10°. The results are shown in Table 1.

TABLE 1

| | | Example | Comparative Example | |
|---|---|---|---|---|
| | | 1 | 1 | 2 |
| Dimple arrangement | | FIG. 1 | FIG. 6 | FIG. 7 |
| Number of dimples | Non-circular | 224 | 224 | — |
| | Circular | 114 | 114 | 432 |
| | Total | 338 | 338 | 432 |
| Radius of curvature (R) at junction of edge elements | | about 6 mm | about 0 mm | — |
| Ratio of total area of dimples to surface area of golf ball *1 | | about 100% | about 100% | 78% |
| Ratio of total space of dimples to volume of golf ball *2 | | about 1.59% | about 1.59% | about 1.3% |
| Test results | Carry (m) | 221.5 | 219.2 | 216.5 |
| | Total (m) | 231.0 | 228.8 | 225.1 |

Note:

*1: In Examples 1 and Comparative Example 1, the edge was formed such that its cross section is arcuate, with the radius of curvature (r) being 1.2 mm. Therefore, the area of the flat part is substantially zero and the entire spherical surface is covered substantially by dimples.

*2: The ratio of the total space of dimples to the volume of the golf ball is expressed in percentage calculated from A/B × 100, where A is the total space of dimples that exists between the outermost periphery (Y) of the golf ball and the wall surface of dimples, and B is the volume of the golf ball surrounded by the outermost periphery (Y) of the golf ball. See FIG. 4.

The invention claimed is:

1. A golf ball having on its surface a number of dimples and a number of edges separating dimples from each other, wherein said edges are formed from a plurality of edge elements joined together such that some of the joining parts of said edge elements assume a smoothly curved shape as viewed from above, wherein the dimples are formed by combination of circular dimples and non-circular dimples.

2. The golf ball of claim 1, wherein the proportion of the non-circular dimples to the total of the dimples is 50 to 75%.

3. The golf ball according to claim 1, wherein the smoothly curved shape is a smoothly curved corner of a non-circular dimple.

4. The golf ball according to claim 1, wherein at least one of the smoothly curved joining parts is provided between a circular dimple and a non-circular dimple.

5. The golf bail according to claim 4, wherein another joining part provided between two non-circular dimples is straight as viewed from above.

6. A golf ball having on its surface a number of dimples and a number of edges separating dimples from each other, wherein the dimples include non-circular dimples, and wherein said edges are formed from a plurality of edge elements joined together such that some of the joining parts of said edge elements dividing the non-circular dimples assume a smoothly curved shape as viewed from above, wherein the wall surface of dimples which continues from the curved joining part of the edge elements is formed in a curved shape like the curved joining part.

7. The golf ball according to claim 6, wherein the smoothly curved shape is a smoothly curved corner of a non-circular dimple.

8. The golf ball according to claim 6, wherein at least one of the smoothly curved joining parts is provided between a circular dimple and a non-circular dimple.

9. The golf ball according to claim 8, wherein another joining part provided between two non-circular dimples is straight as viewed from above.

10. A golf ball having on its surface a number of dimples and a number of edges separating dimples from each other, wherein said edges are formed from a plurality of edge elements joined together such that some of the joining parts of said edge elements assume a smoothly curved shape as viewed from above, wherein it is hypothesized that the golf ball is a sphere having no dimples on its surface, the ratio of the space of dimples to the volume of the hypothetic sphere is 1.1 to 1.7%.

11. The golf ball according to claim 10, wherein the smoothly curved shape is a smoothly curved corner of a non-circular dimple.

12. The golf ball according to claim 10, wherein at least one of the smoothly curved joining parts is provided between a circular dimple and a non-circular dimple.

13. The golf ball according to claim 12, wherein another joining part provided between two non-circular dimples is straight as viewed from above.

14. A golf ball having on its surface a number of dimples and a number of edges separating dimples from each other, wherein the dimples include non-circular dimples, and wherein said edges are formed from a plurality of edge elements joined together such that some of the joining parts of said edge elements dividing the non-circular dimples assume a smoothly curved shape as viewed from above, wherein each of the dimples comprises a concave bottom wall surface.

15. The golf ball according to claim 14, wherein the smoothly curved shape is a smoothly curved corner of a non-circular dimple.

16. The golf ball according to claim 14, wherein at least one of the smoothly curved joining parts is provided between a circular dimple and a non-circular dimple.

17. The golf ball according to claim 16, wherein another joining part provided between two non-circular dimples is straight as viewed from above.

* * * * *